United States Patent [19]

Marshall

[11] 3,973,476

[45] Aug. 10, 1976

[54] CUTTING DIE FOR SEALING CORRUGATED BOARD

[75] Inventor: Elmer Marshall, Monroe, La.

[73] Assignee: Olinkraft, Inc., West Monroe, La.

[22] Filed: Jan. 27, 1975

[21] Appl. No.: 543,995

Related U.S. Application Data

[62] Division of Ser. No. 175,144, Aug. 26, 1971, Pat. No. 3,864,200.

[52] U.S. Cl. ..... 93/59 ES; 93/58 ST; 93/58.5

[51] Int. Cl.[2] ..... B31B 1/20

[58] Field of Search ..... 76/107 R, 107 C; 93/58 R, 58 ST, 58.3, 58.4, 58.5, 59 R, 59 ES, 36.6, 36 PC, 1 G; 156/198

[56] References Cited

UNITED STATES PATENTS

| | | | |
|---|---|---|---|
| 1,723,149 | 8/1929 | Gannon et al. | 93/58 R |
| 2,552,353 | 5/1951 | Troth et al. | 93/58 R |
| 2,675,873 | 4/1954 | Weirich et al. | 93/1 G |
| 3,406,052 | 10/1968 | Peters | 156/198 |
| 3,540,354 | 11/1970 | Tachibana | 93/1 R |

*Primary Examiner*—James F. Coan
*Attorney, Agent, or Firm*—Pugh & Keaty

[57] ABSTRACT

A waterproof corrugated board construction for use in the Hydro-cooling process for preparation of produce and/or fruit shipped in a container formed of the corrugated board. The box construction using the corrugated board comprises a combination of a corrugated sheet having attached to the crest of the corrugation at least one substantially flat waterproof lining with the construction also containing a coating of a deformable water-proofcomposition and having the edges of the corrugated sheet compessed and retained by the action of the deformable composition in an amount sufficient to seal the edges from entry of water during the Hydro-coolng process.

Also disclosed is a method for providing a liquid sealed box from the corrugated board construction. In addition, there is disclosed an improved cutting die for use in forming the waterproof box blank described herein.

10 Claims, 4 Drawing Figures

CUTTING DIE FOR SEALING CORRUGATED BOARD

This is a division of application Ser. No. 175,144 filed Aug. 26, 1971, entitled "Waterproof Corrugated Board" being issued as U.S. Pat. No. 3,864,200 on Feb. 4, 1975.

BACKGROUND OF THE INVENTION

This invention relates generally to an improved cutting die for sealing or waterproofing corrugated board to produce for example an improved waterproof corrugated box for use in the Hydro-cooling process, the box having all of its exposed edges sealed by means of the cutting die of the present invention.

In order to slow down the decay rate of produce and/or fruit to allow the produce and/or fruit to reach the market place in a fresh and prime condition, the process of Hydro-cooling was developed. Basically, this process is used by the produce and/or fruit growers and packers wherein the product to be shipped is placed in a shipping container or box which then goes through a bath and/or shower of ice water anywhere from three minutes to one hour depending upon the type of product in the box. The purpose of the ice water bath is to super cool the product prior to shipment.

Since most of the boxes in which these products are shipped are made from corrugated paper, problems have been encountered using standard corrugated paper boxes for the shipping container since the paper often got soft and pulpy after contact with the water and moisture. In attempting to develop improved boxes in the laboratory, it was found that by coating the container with a wax impregnation and coating certain of the exposed edge surfaces of the box that a somewhat acceptable job of creating a usable container was accomplished.

When the wax impregnated boxes were tested in the laboratory, it was observed that, under Hydro-cooling process water conditions, the water impregnated between the inner and outer liners of the corrugated box through seepage from exposed edges thereby soaking into the corrugating medium and softening it thereby allowing the box to collapse. Other box manufactures have attempted to solve this problem by the use of corrugated board constructions comprising a pair of corrugated inner sheets having been laminated together with an asphalt wax composition. One such construction is shown in the U.S. Pat. No. 3,579,413 issued May 18, 1971, to Russell E. Koons. This type of corrugated construction, while being of beneficial use as a waterproof container in itself, was not found to completely solve the problem since the process water often seeped through the exposed edges of the box and through the exposed edges of the holes contained within the box resulting in eventual box collapse.

SUMMARY OF THE INVENTION

In order to solve the problems encountered in the prior art boxes, the new and novel invention described herein provides a greatly improved waterproof corrugated board box having the edges of the box as well as the edges of the holes contained within the box sealed off by the action of the deformable waterproof composition and the novel method also described herein. The sealing off of these edges thusly keeps the water away from the interior portion of the corrugated medium solving the problem long encountered in the art.

Accordingly, it is an object of the invention to provide a new and novel corrugated board construction wherein the edges of the corrugated sheet are compressed in an amount sufficient to seal the edges of the sheet from the entry of water whenever the corrugated board having the deformable waterproof composition construction is used in a box which is subsequently treated in a Hydro-cooled process.

Another object of the invention is to provide a new and novel waterproof corrugated box construction wherein the edges of the holes contained within the box are also compressed a sufficient amount to seal the edges of the holes from the entry of water during the Hydro-cooling process.

Still another object of the invention is to provide a new and improved corrugated box construction which may be used in the Hydro-cooled process without danger of collapse of the sides and bottom portion of the box after a long exposure to low temperature ice and water.

Yet another object of the invention is to provide a new and improved method for providing a liquid sealed box from a corrugated board construction by the new and improved process of cutting the exposed edges of the corrugated board with a new and novel cutting die which crushes the edges of the blank a predetermined amount sufficient to seal the edges from liquid.

Still another object of the invention is to provide a new cutting die for use in the formation of a waterproof box to provide the box with sealed edges.

These and other objects and advantages will become apparent from a reading of the following specification and from a review of the attached drawing.

DESCRIPTION OF THE PREFERRED EMBODIMENT

Figure 1:
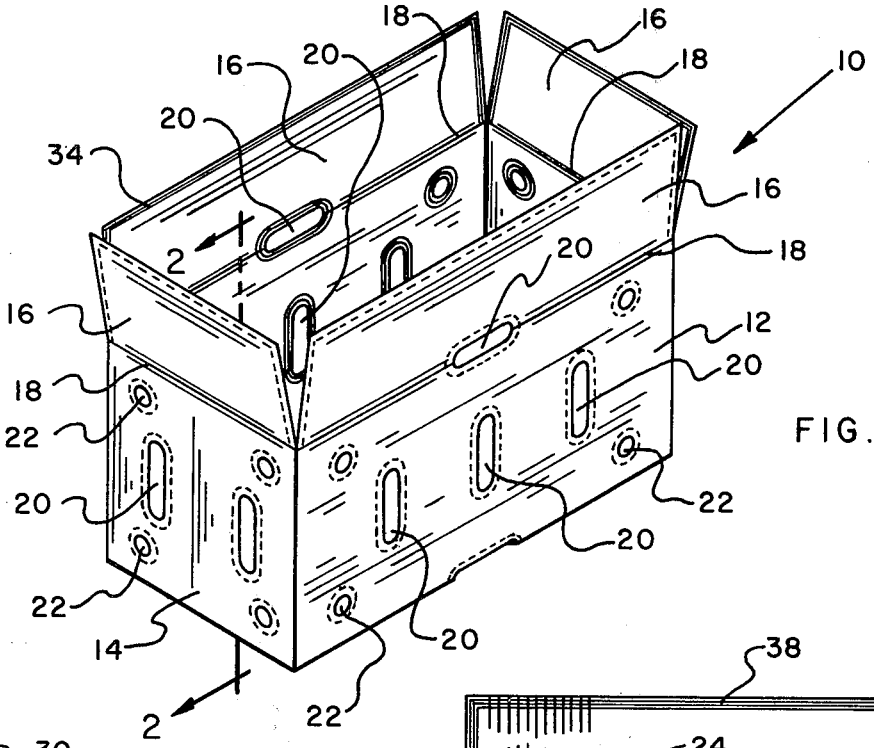
FIG. 1 shows the new and novel corrugated board box in perspective showing the new and novel crushed edges in heavy lines on an inner portion of the box.

Referring now to the drawings in general and particularly to FIG. 1 of the drawing, there is shown the new and novel corrugated box generally by the numeral 10 which comprises sides 12, ends 14, and top flaps 16 hingedly connected to the ends 14 and sides 12 by means of the scorelines 18. The bottom portion of the box 10, while not shown in the drawing, comprises bottom flaps similar to the top flaps 16 which are sealed by means well known in the art and forming no part of this invention.

The box 10 has formed in the sides 12 and in the ends 14 thereof, a plurality of elongated holes 20 and a plurality of circular holes 22. The configuration of the holes 20 and holes 22 and the placing thereof around the sides 12 and ends 14 is determined by the amount of water necessary to be forced into the container during the Hydro-cooling process, which is well known in the art and forms no portion of this invention.

Figure 3:
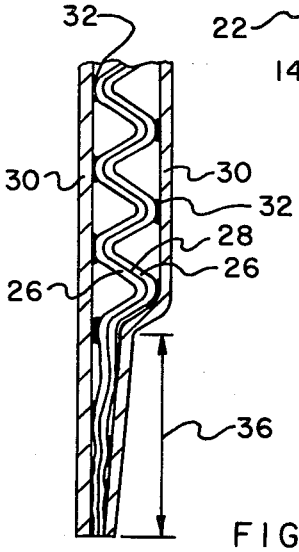
FIG. 3 is an enlarged cross-section taken along lines 3—3 of one of the edges of the corrugated box showing the sealed edges.
Figure 2:
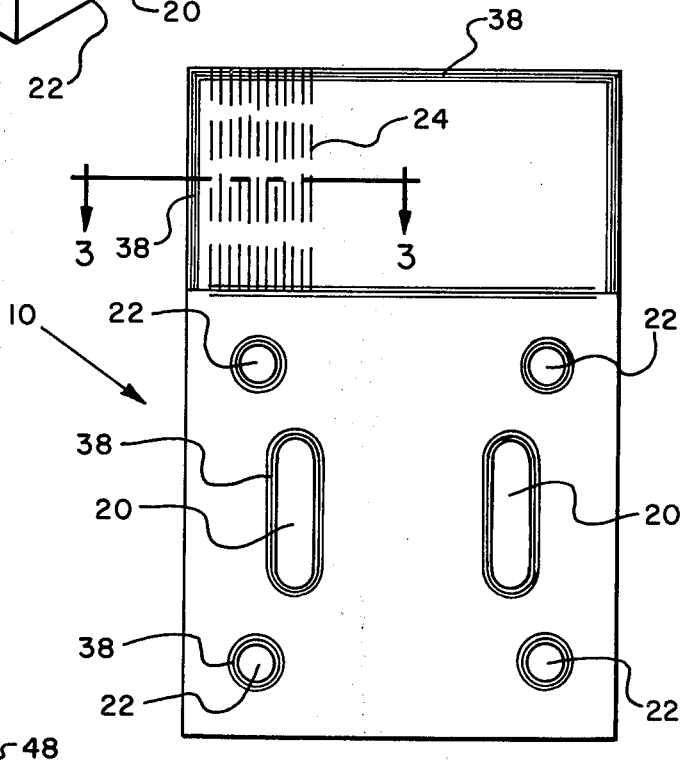
FIG. 2 is an elevational view of the end portion of the box looking from the inside of the box along the lines 2—2.

Referring now to FIG. 2 of the drawing, there is shown an internal elevational view taken along lines 2—2 of the end 14. The box 10 is constructed as before mentioned by means well known in the art comprising corrugated sheets having attached to the crests thereof some preferred type of waterproof lining sheet. The corrugated inner sheet is shown in FIG. 2 by the dashed lines 24 and is also shown more pictorially in FIG. 3 of the drawing which is taken along line 3—3 of FIG. 2. In the preferred embodiment of the invention, the corrugated box would be constructed of a pair of corrugated sheets 26 being laminated together by a deformable waterproof composition in the form of asphalt 28 as shown in FIG. 3 of the drawings. The corrugated sheet 26 may be constructed of the commonly known flute contours designated "A," "B," "C," or "E" flute and as more fully described in the "Handbook of Pulp and Paper Technology," second edition, published 1970 by Litton Educational Publishing, Inc. The corrugated sheets 26, having the deformable asphalt 28 impregnated there between, may be securely fastened to waterproof lining sheets 30 by means of a waterproof glue 32. The liner sheets may be constructed of wet strength line board for use in the Hydro-cooled container which is sized with a solution of Urea-formaldehyde. The corrugated sheets 26 may preferably be formed with regular 50 lb. bag paper stock having a weight of 17 lbs. per thousand square feet.

In order to prevent the water used in the Hydro-cooling process from entering into the central portion of the corrugated box sides between the lining sheets 30, it was found that it was necessary to seal the edges in a manner sufficient to keep the water out since the glue 32 did not always perfectly seal the inside from moisture running in from the edges. As before mentioned, one prior art attempt to seal the edges of the box consisted of spraying wax on the edges prior to the start of the Hydro-cooling process, but this proved unsatisfactory. Another prior art attempt at sealing the edges was by the use of a scoreline along the edges of the box. This also failed to perform satisfactorily since the scoreline did not compress the edges back a sufficient amount so that adequate sealing was assured.

However, due to the use of the new and novel method of sealing the edges hereinafter described in combination with the deformable waterproof composition, it was found that whenever the edges 34 of the top and bottom flaps 16 were sealed the distance shown by the arrow 36 that a far superior sealing of the box would be obtained since the holding properties of the deformable composition tend to maintain the crushed portion thereby effecting a permanent seal. In the preferred form of the embodiment, the crushing of the edges would be in the range of 1/2 inch to 1 inch in width along the entire exposed edges of the top and bottom flaps 16 as well as around the edges of the elongated holes 20 and the circular holes 22; however, it is within the spirit and scope of the invention that the crushed area could be a greater or lesser amount. In addition, it is also conceivable that sufficient crushing could be accomplished by the action of the corrugator in manufacturing the blank or by the action of a worn cutting die. In FIGS. 1 and 2 of the drawings, the crushed edges of the top and bottom flaps 16 and the holes 20 and 22 are shown by means of the shaded lines 38. In the embodiment shown, these crushed edges are contained on the interior portion of the box for aesthetic purposes; however, it is within the spirit and scope of the invention that these compressed edges could be contained equally as well on the outer side of the box 10.

Figure 4:
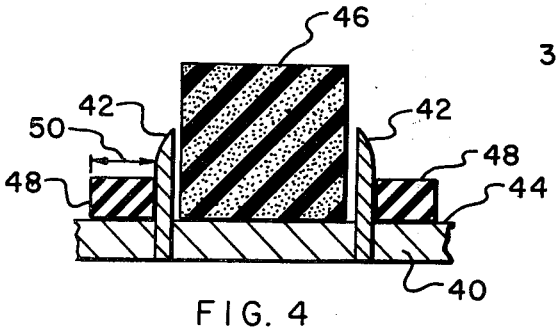
FIG. 4 is a cross-section taken through the new and novel cutting die used in the new and novel method for forming the liquid-sealed box having crushed edges as herein before mentioned.

In the preferred embodiment, the crushed edges 38 of the box are obtained by use of the new and novel cutting die shown in FIG. 4 of the drawing which comprises a wooden frame 40 having fastened thereto a series of hardened cutting surfaces 42 formed in the necessary configuration for obtaining the desired cut around the box board blank. Formed on the upper portion 44 of the frame 40 is a soft sponge rubber stripper 46 of the type shown in the prior art U.S. Pat. No. 3,167,985 issued Feb. 2, 1965, to J. B. Madsen. Formed on the other side of the cutting surface 42 and on the upper portion 44 of the frame 40 is the new and novel means for crushing the edges of the corrugated box in the form of a hardened rubber block 48 formed from a very high density neoprene rubber having a Durometer reading in the range of 70. The width 50 of the hard rubber crusher block 48 conforms to the length of the crushed edges desired as shown by the arrow distance 36 in FIG. 3 and may vary according to the size and type of corrugated flute used in the box construction. It should be obvious that materials other than the high density neoprene rubber may be used as a crusher block 48 within the spirit and scope of the invention as long as the other materials contain sufficient rigidity to crush the boxes to the desired height necessary to prevent entry of water during the Hydro-cooled process.

In a more preferred form of the embodiment, it was found that by using the combination of the small "B" flute having tiny exposed edges and taking advantage of the fact that the asphalt 28 is tacky and gluey and has adhesive qualities when warm, the exposed edges are crushed down during the cutting process when using the cutting die shown in FIG. 4. The asphalt picks up heat from the corrugator during the corrugation process. The result has been a superior Hydro-cooled corrugated paper container having its edges sufficiently sealed to prevent entry of water during the Hydro-cooled process thereby alleviating the collapse of the container as often encountered in prior art structures.

When practicing the method of the invention, a cutting die is provided having formed on one side thereof a crusher block for crushing the edges of the blank and the corrugated box blank is cut with the cutting die so that the crusher block compresses the edges of the blank a predetermined amount determined by the rigidity of the crusher block and the type of flute used, an amount sufficient to seal the edges from liquid whenever the blank is formed into a waterproof box.

From the above, it can be seen that there has been provided a new and novel waterproof corrugated board construction of the the type heretofore unknown in the art having new and novel crushed edges crushed by the new and novel method detailed herein before. It will readily be seen that the invention described herein is capable of modifications other than that shown in the drawing and the invention is not to be limited by the illustrated preferred embodiment, but only by the scope of the following claims.

Having described my invention, what is claimed is:

1. An improved cutout die for cutting out holes in a waterproof box blank from a waterproof corrugated board construction comprising, in combination:

a. a frame;

b. a hardened cutting surface means extending above said frame formed in closed array on the frame for cutting out holes in said waterproof corrugated board; and c. a non-compressable crusher block means, formed on said frame surrounding in close proximity said cutting surface means and extending above said frame but having a height less than said cutting surface means for completely compressing the corrugated board flutes in proximity to the cut made by said cutting surface means to seal the flutes of the board during formation of the box blank.

2. The improved cutout die for cutting out holes as defined in claim 1 further comprising the non-compressable crusher block being formed of hardened rubber.

3. The improved cutout die for cutting out holes as defined in claim 2 further comprising said hardened rubber being of a very high density neoprene rubber having a Durometer reading in the range of 70.

4. The improved cutout die for cutting out holes as defined in claim 1 further comprising the non-compressable crusher block being formed so that its outer edges are approximately ½ inch to 1 inch away from the cutting die and its inner edge is in juxtaposition with the cutting die.

5. The improved cutout die for cutting out holes as defined in claim 1 further comprising the die having a series of hardened cutting surfaces forming said cutting surface means and further comprising each cutting surface having a non-compressable crusher block, which provides said crusher block means, formed on the frame in juxtaposition to the cutting surface.

6. The improved cutout die for cutting out holes as defined in claim 1 further comprising the non-compressable crusher block being formed so that its outer edge is approximately ½ inch to 1 inch away from the hardened cutting surface and its inner edge is in juxtaposition with the hardened cutting surface.

7. The improved cutout die for cutting out holes as defined in claim 1 further comprising said cutting surface means forming and defining an elongated oval configuration for cutting out holes that have an elongated oval configuration.

8. The improved cutout die for cutting out holes as defined in claim 1 further comprising said cutting surface means forming and defining a circular configuration for cutting out holes that have a circular configuration.

9. The improved cutout die for cutting out holes as defined in claim 1 further comprising, in combination:

d. compressable resilient stripper means, located on said frame within the closed array confines of said cutting surface means extending above said frame and having a height greater than said cutting surface, for stripping the box blank material from the hole cut out by said cutting surface means.

10. The improved cutout die for cutting out holes as defined in claim 9 further comprising said stripper means being of sponge rubber.

* * * * *